United States Patent [19]

Gupta et al.

[11] Patent Number: 4,472,195

[45] Date of Patent: Sep. 18, 1984

[54] PROCESS FOR DECARBURIZING ALLOY MELTS

[75] Inventors: Debabrata Gupta, New Haven; John C. Yarwood, Madison, both of Conn.

[73] Assignee: Olin Corporation, New Haven, Conn.

[21] Appl. No.: 523,250

[22] Filed: Aug. 15, 1983

[51] Int. Cl.[3] ..... C21C 7/00

[52] U.S. Cl. ..... 75/60; 75/59

[58] Field of Search ..... 75/60, 59

[56] References Cited

U.S. PATENT DOCUMENTS

| | | | |
|---|---|---|---|
| 2,962,277 | 11/1960 | Morrill | 75/60 |
| 3,046,107 | 7/1962 | Nelson | 75/59 |
| 3,252,790 | 5/1966 | Krivsky | 75/59 |
| 3,396,011 | 8/1968 | Trentini | 75/52 |
| 3,754,892 | 8/1973 | Ando | 75/60 |
| 3,953,199 | 4/1976 | Michaelis | 75/60 |
| 4,178,173 | 12/1979 | Gorges | 75/60 |
| 4,356,035 | 10/1982 | Brotzmann | 75/60 |

OTHER PUBLICATIONS

Irving, "The LBE Process Takes Hold Worldwide," Iron Age, pp. MP-26 and MP-29, (12/6/82).

Ishida, "Some Improvements for the Refractory Performance of 20 Ton AOD Vessel in Last 3 Years," 3rd Int'l Iron & Steel Congress, pp. 150-157, (1978).

Krivsky, "Linde Ar-Oxygen Process for Stainless Steel," Metallurgical Transactions, pp. 1439-1447, (1973).

McManus, "Bottom Stirring Makes its North American Debut," Iron Age, pp. MP-13, MP-15 and MP-18, (5/3/1982).

*Primary Examiner*—Peter D. Rosenberg

*Attorney, Agent, or Firm*—Howard M. Cohn; Paul Weinstein; Barry L. Kelmachter

[57] ABSTRACT

The present invention relates to either a batch or continuous process for decarburization of metals and metal alloys. A shallow melt of metal or metal alloy having a depth of between about 2 in. to about 24 in. is provided. The carbon content of the melt is reduced from its initial value to a range of about 0.3 to 0.1 wt. % carbon. To accomplish this reduction, an oxygen enriched gas is blown onto the surface of the melt at a velocity of about 10 to about 50% of supersonic velocity so as to decarburize the melt without creating any substantial splashing of the melt. At the same time, the melt is stirred by injecting an inert gas below the melt surface. Subsequently, the carbon content of the melt is further reduced from the carbon percentage achieved in the first reduction to a value of not less than about 0.001 wt. % carbon. This latter step is accomplished by injecting a gas mixture comprising an oxygen enriched gas and an inert gas having a ratio of between about 4:1 oxygen enriched gas to inert gas to about 1:10 oxygen enriched gas to inert gas below the surface of the melt for both decarburizing and stirring the melt.

19 Claims, 2 Drawing Figures

PROCESS FOR DECARBURIZING ALLOY MELTS

While the invention is subject to a wide range of applications, it is especially suited for the decarburization of an alloy melt and will be particularly described in that connection.

The Argon Oxygen Decarburization (AOD) process is a widely accepted method for the secondary refining process of making stainless steel and other alloys. The process is described in an article entitled "The Linde Argon-Oxygen Process for Stainless Steel; A Case Study of Major Innovation in a Basic Industry" by Krivsky as reported in *Metallurgical Transactions,* 1973, pages 1439–1447. Current industrial applications of the process are described in an article entitled "Some Improvements for the Refractory Performance of 20 Ton AOD Vessel in Last Three Years" by Ishida et al. as reported in The Proceedings of Third International Iron and Steel Congress, 1978, pages 150–157. In these applications, various mixtures of inert gases, e.g. argon, nitrogen, were mixed with oxygen and injected through horizontal tuyeres submerged in the melt contained in a batch-type converter vessel. Acceptable decarburization rates in conjunction with minimum chromium loss were described as being obtained by proper control of the inert gas/oxygen ratio.

The recently developed Lance Bubbling Equilibrium (LBE) process for steel making utilizes bottom-injection of inert gases in conjunction with the established supersonic top-blowing of oxygen in large batch vessels. This process has been described in an article by McManus entitled "Bottom Stirring Makes its North American Debut" in *Iron Age,* May 3, 1982, pages MP-13, MP-15 and MP-18, and in an article by Irving entitled "The LBE Process Takes Hold Worldwide" in *Iron Age,* Dec. 6, 1982, pages MP-26 and MP-29. The claimed advantages of this process include acceptable rates of decarburization with a lower volume of slag and loss of metallics as well as a very low end carbon level of less than 0.01 wt. %.

Both of the above processes are suitable for melts having a depth of greater than about 120 cm. because of the potential problems associated with insufficient jet breakup, consequent melt splash and inadequate mixing in shallow baths. However, the applicability of these deep bath processes is limited when continuous decarburization at low throughput rates is contemplated. Moreover, highly specialized equipment including supersonic lances or gas-cooled tuyeres are necessary for the LBE and AOD processes, respectively.

It has also been disclosed in U.S. Pat. No. 4,178,173 to Gorges et al. for example, " . . . an improvement in a process for preparing a stainless steel of low carbon content from a steel melt containing chromium or chromium nickel of higher carbon content where the process is carried out in a converter having at least one blast nozzle below the molten steel bath level and at least one blast lance above the bath level wherein oxygen is supplied to the steel melt through the blast lance nozzle during a first refining phase, and in a succeeding refining phase oxygen is combined with inert gas and introduced through the blast nozzles to the steel melt, the proportion of the oxygen being reduced in relationship to the proportion of inert gas with decreasing carbon content of the of the steel melt." Other techniques of processing steel are disclosed in U.S. Pat. Nos. 3,396,011 to Trentini, 3,754,892 to Ando et al. and 4,356,035 to Brotzmann et al.

In laboratory scale decarburization of shallow melts of metal or metal alloy, injection of an oxygen/argon mixture into a melt has resulted in violent ejection of metal droplets causing a high percentage of melt loss. In a decarburization trial, a 9 cm. deep, 10 lb. melt in the high carbon range of 0.8 to about 1.0 wt. % carbon was injected with an argon/oxygen gas mixture. Violent spitting of the melt resulted and about 30% of the melt was lost. Since similar spitting was not observed while injecting an equivalent amount of pure argon into identical melts, the ejection of the metal droplets was ascribed to high speed carbon monoxide bubbles formed by decarburization and insufficient energy transfer within the shallow melt. The results indicate the inapplicability of straightforward AOD type processing for relatively shallow high carbon melts.

It is a problem underlying the present invention to provide a process for decarburization of a shallow melt of metal and metal alloys which does not result in a significant loss of the melt.

It is an advantage of the present invention to provide a process for decarburization of metals and metal alloys which obviates one or more of the limitations and disadvantages of the described prior processes.

It is a further advantage of the present invention to provide a process for decarburization of a shallow melt of metals and metal alloys which can be accomplished in a relatively efficient and economic manner.

It is still a further advantage of the present invention to provide a process for decarburization of a shallow melt of metal or metal alloys particularly applicable to continuous decarburization of melts at relatively low flow rates in shallow transfer systems.

Accordingly, there has been provided a shallow melt of metal or metal alloy having a depth of between of about 2 to 24 in. The carbon content of the melt is reduced from its initial value to a range of about 0.3 to 0.1 wt. % carbon. To accomplish this decrease, an oxygen enriched gas is blown onto the surface of the melt at a velocity of about 10 to 50% of supersonic velocity so as to decarburize the melt without creating any substantial splashing of the melt. At the same time, the melt is stirred by injecting an inert gas below the melt surface. Subsequently, the carbon content of the melt is further reduced from the prior carbon percentage achieved to a value of not less than about 0.001 wt. % carbon. The latter step is accomplished by injecting a gas mixture comprising oxygen rich gas and an inert gas having a ratio of between about 4:1 oxygen rich gas to inert gas to about 1:10 oxygen rich gas to inert gas below the surface of the melt for both decarburizing and stirring the melt.

The invention and further developments of the invention are now elucidated by means of the preferred embodiments in the drawings.

The present invention is concerned with the process of decarburizing metal or metal alloys which will absorb carbon. These are conventionally nickel and ferrous alloys but can include other materials, such as for example, cobalt, silicon, chromium and manganese alloys.

Figure 1:
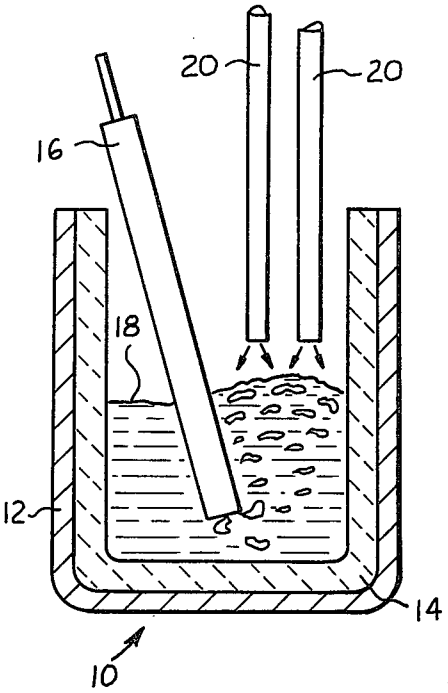
FIG. 1 is a schematic of batch decarburization of a shallow melt in accordance with the present invention.

While various types of apparatus might be utilized in carrying out the invention, the reactor illustrated in FIG. 1 may be utilized to describe typical batch processing. The reactor 10 may be comprised of a steel vessel 12 lined with refractories 14. The specific refractories are chosen to insulate the vessel so as to provide thermal efficiency. They also resist melt and slag attack of the vessel which act to degrade the vessel and the melt being treated. Preferably, the refractory is inert to the particular melt within the reactor. Factors such as themal efficiency, reactivity of materials and the cost must all be considered in deciding the most suitable refractory lining. The reactor is sized to receive a shallow melt.

The decarburization process of the present invention requires two primary steps. During the first step, the carbon content of the melt is reduced from its initial value to a range of about 0.3 to 0.1 wt. % carbon. Preferably, the first step reduces the carbon content of the melt to the range of about 0.2 to 0.1 wt. % carbon. The second step further reduces the carbon content from the carbon percentage achieved in the first step to a value of not less than about 0.001 wt. % carbon. The final amount of carbon desired in the melt is determined by the specific application for which the melt is to be applied.

The initial step of decarburizing is accomplished by blowing oxygen enriched gas through the top-blowing lances 20 to cover the surface of the melt. The oxygen rich gas is normally constituted of oxygen but may include other gases such as carbon dioxide, carbon monoxide, nitrogen and argon. The oxygen is blown through top-blowing lances 20 at a velocity of about 10 to about 50% of supersonic velocity so as to prevent any substantial splashing of the melt. Preferably, the oxygen is delivered at a velocity of about 15 to about 30% of supersonic velocity. This lower velocity, as compared with the supersonic velocity used in the conventional decarburizing of steel, reduces the melt losses from splashing. This is a very important factor with regards to the shallow baths of the present invention. Concomitant with providing an oxidizing environment above the surface 18 of the melt, an inert gas such as argon or nitrogen is injected below the surface of the melt with lance 16. The inert gas continuously stirs the melt so that fresh unoxidized melt is exposed to surface 18 to contact the oxidizing gas. Although a lance is illustrated, it is within the terms of the present invention to substitute other conventional apparatus such as a sparge ring or porous plug in the bottom of the reactor vessel.

The second step of decarburizing begins after the carbon content of the melt is reduced from its initial value to an intermediate value in the range of about 0.3 to about 0.1 wt. % carbon. At that point, the blowing of oxygen onto the melt surface through the lances 20 is ceased. A gas mixture comprising a suitable oxidizing gas such as oxygen or carbon dioxide, and an inert gas such as argon or nitrogen is injected below the surface of the melt through the lance 16. This gas mixture may have a ratio of between about 4:1 oxidizing gas to inert gas to about 1:10 oxidizing gas to inert gas. The gas mixture acts to simultaneously decarburize and stir the melt. The second process step continues for the time required for the carbon content of the melt to be reduced to a range required for the alloy.

The top-blowing decarburization step applied to a melt having a high carbon level is particularly advantageous because of the non-splashing nature of the process. During this step, carbon in the melt readily reduces any metallic oxides formed at its surface. However, as the carbon level of the melt is reduced, oxides, such as chromium oxide, formed at the melt surface from top-blowing are less readily reduced by the lower activity carbon. As a result, oxygen cannot enter the melt as easily with the top-blowing technique. If the total decarburizing was attempted with only the first step, a relatively unclean final melt having undesirable oxidized components, such as chromium oxide, would result. To control this problem, the second process step of injecting the combined oxygen and argon gas directly into the melt is required. The injected gas, having a lower oxygen content than in the first step, decreases the tendency for oxidation of any strong oxide forming element such as chromium. The second step also has the advantage of injecting oxygen directly into the melt.

A shallow melt in this range has certain advantages over the typical bath depth in the steel industry of about 30 to about 60 in. A shallow bath allows the melt to be more easily heated and maintained at the desired temperature. Also, there is more surface area per unit volume of melt and, therefore, the process of surface decarburizing can be conducted more efficiently. Another advantage of the shallow depth is the reduction in stratification of temperature and alloy elements within the melt. Generally, the smaller melt is easier to handle and the small reactor vessel needed to handle the shallow melt is easier to repair. The process of the present invention is primarily concerned with reducing the carbon content of a shallow nickel or iron base alloy melt.

The process of the present invention was demonstrated in decarburizing a small chromium-bearing melt (approximately 10 lbs.) contained in a magnesia crucible or reactor of the type shown in FIG. 1. For step 1, oxygen was blown through a lance onto the melt surface at the rate of 5.2 liters/minute. The lance had an approximate 1.5 mm. outlet diameter which was positioned about 1.5 cm. above the melt surface. The melt was simultaneously stirred by 2 liters/minute of argon gas blown through a magnesite/alumina lance. This process was continued for about 15 minutes. Step 2 began by stopping top-blowing of oxygen and adding 1 liter/minute of oxygen to the stirring argon gas stream. In a total treatment time of 22 minutes, the carbon content of the melt was reduced from about 0.9 to about 0.008 wt. % carbon. This yields an average decarburization rate of 0.04 wt. % carbon/minute with negligible chromium loss. This rate is believed to be superior to that obtained in industrial AOD practice. For example, data from Ishida et al. indicates a maximum decarburization rate of approximately 0.03 wt. % carbon/minute at a considerably higher carbon content of 1.5%.

Figure 2:
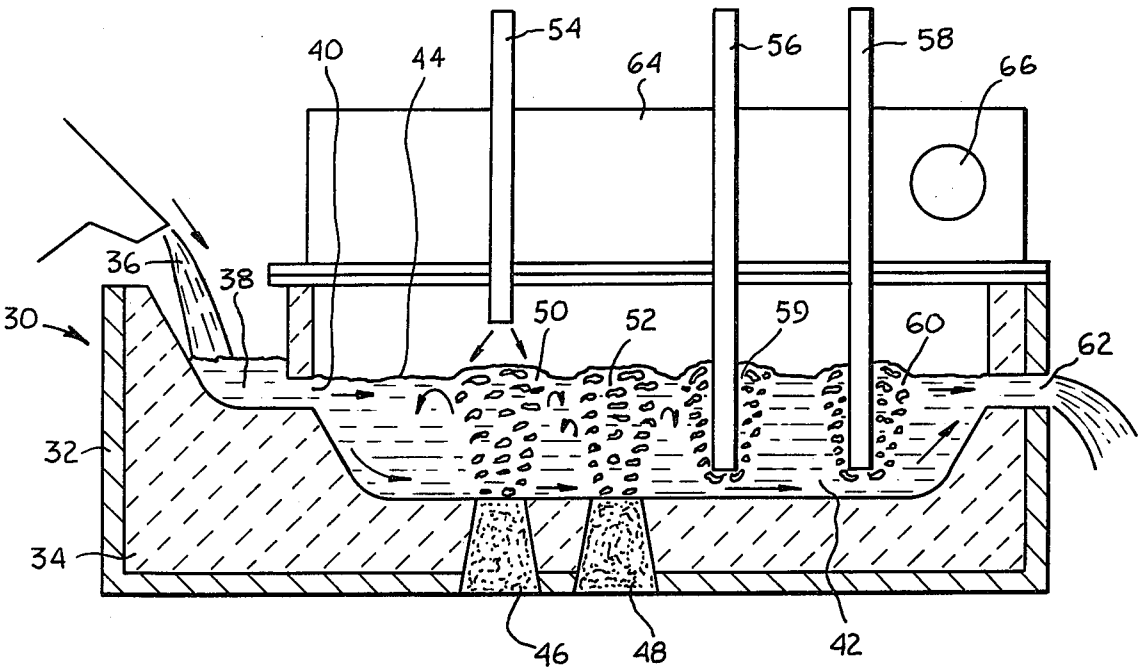
FIG. 2 is a schematic of a shallow continuous decarburization treatment system for processing a melt in accordance with the present invention.

The second embodiment of the present invention, providing a continuous decarburization process, is illustrated in FIG. 2. A suitable continuous reactor 30 may be formed of a steel shell 32 with a refractory lining 34 similar to the lining of embodiment one illustrated in FIG. 1. The melt 36 may be poured by any conventional means into the foreheath 38. It then passes through orifice 40 to form a shallow bath 42 having a top surface 44. The first step of the process requires injection of an inert gas, such as argon, below the surface of the melt through any number of porous plugs 46 and 48 as required. It is also within the scope of the present invention to use any conventional gas delivering means such as a surface lance or sparge ring above or in combination with the porous plugs. The plumes of argon bubbles 50 and 52 rise up through the melt and cause a stirring action, as indicated by arrows, to bring fresh melt up to the surface 44. Concurrently therewith, an oxygen enriched gas, as in the first embodiment, is delivered through a lance 54 onto the surface of the melt. As in the first embodiment, the oxygen enriched gas, normally oxygen, is delivered at a subsonic speed of about 10 to 50% of supersonic velocity and preferably about 15 to 30% of supersonic velocity. Although a single lance 54 is illustrated, it is within the terms of the present invention to provide as many lances with single or multiple nozzles as desired so as to cover the surface of the melt with an oxygen environment.

The melt continues to move downstream and encounters two nozzles 56 and 58 which inject a gas mixture comprising oxygen enriched gas and an inert gas for simultaneously decarburizing and stirring the melt. It is within the terms of the present invention to use any number of these nozzles as desired. Further, the nozzles may be replaced by porous plugs, sparge rings or any other apparatus for delivering gas. As with the first embodiment, the gas mixture comprises oxygen enriched gas and an inert gas having a ratio of between about 4:1 oxygen enriched gas to inert gas to about 1:10 oxygen enriched gas to inert gas.

The speed of the melt flow is balanced with the gas inputs so that the carbon content of the melt is decreased from its initial value to a range of about 0.3 to 0.1 wt. % carbon by the time the melt has passed the plume 52. As the flow continues and passes the plume 60 associated with the lance 58, the carbon content is further reduced to between the percentage achieved after plume 52 and a value of not less than about 0.001 wt. % carbon. Finally, the melt passes through outlet 62 where it can be delivered to any desired location.

The reactor 30 includes a top cover 64 having an exhaust port 66 therein. The cover prevents spillage of the melt while the exhaust port allows gas exhaust from above the melt.

An important aspect of the treatment is the residence time of the melt in each of the treatment zones within the reactor 30. The reactor sections must, therefore, be spaced to provide sufficient residence time to allow the decarburization operation to proceed to the extent required.

The patents and publications set forth in this application are intended to be incorporated by reference herein.

It is apparent that there has been provided in accordance with this invention a process for decarburizing a metal or metal alloy melt which fully satisfies the objects, means and advantages set forth hereinabove. While the invention has been described in combination with the embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. In a process for decarburizing of metals and metal alloys, comprising the steps of:

a. providing a shallow melt of metal or metal alloy having a depth of between about 2 to 24 in., said melt comprising a metal or metal alloy, carbon and a strong oxide forming element;

b. reducing the carbon content of the melt from its initial value to an intermediate value in the range of about 0.3 to 0.1 wt. % carbon by:

i. blowing an oxygen enriched gas onto the surface of the metal or metal alloy melt at a velocity of about 10 to about 50% of supersonic velocity so as to decarburize the melt without creating any substantial splashing of the melt; and ii. simultaneously stirring said melt by injecting an inert gas below the surface of the melt; and c. reducing the carbon content of the melt from the intermediate value to a final value of not less than about 0.001 wt. % carbon by:

i. injecting a gas mixture comprising an oxygen enriched gas and an inert gas having a ratio of between about 4:1 oxygen enriched gas to inert gas to about 1:10 oxygen enriched gas to inert gas below the surface of the melt; and ii. selecting said ratio of an oxygen enriched gas and an inert gas to decrease the tendency for oxidation of said strong oxide forming element within the melt while simultaneously decarburizing and stirring the melt.

2. The process of claim 1 wherein said step of providing a shallow melt includes providing a melt having a depth of about 4 to 12 in.

3. The process of claim 1 wherein said step of blowing an oxygen enriched gas includes blowing said enriched gas onto said melt surface at a velocity of about 15 to about 30% of supersonic velocity.

4. The process of claim 3 wherein said step of reducing said carbon content of the melt includes reducing said carbon content from its initial value to an intermediate value in range of about 0.2 to 0.1 wt. % carbon.

5. The process of claim 4 wherein said oxygen enriched gas is primarily oxygen.

6. The process of claim 5 wherein said inert gas is selected from the group comprising nitrogen and argon.

7. The process of claim 1 wherein said metal alloy is an iron base alloy.

8. The process of claim 1 wherein said metal alloy is a nickel base alloy.

9. A process of continuously decarburizing a metal or metal alloy melt, comprising the steps of:

a. transferring a shallow melt of metal or metal alloy having a depth of between 2 to about 24 in. through a plurality of treatment zones, said melt comprising a metal or metal alloy, carbon and a strong oxide forming element;

b. in a first of said treatment zones, decreasing the carbon content of the melt from its initial value to an intermediate value in the range of about 0.3 to 0.1 wt. % carbon by the steps of:

i. blowing an oxygen enriched gas onto the surface of the metal or metal alloy melt at a velocity of about 10 to about 50% of supersonic velocity so as to decarburize the melt without creating any substantial splashing of the melt; and ii. simultaneously stirring said melt by injecting an inert gas below the surface of the melt; and c. in a second of said treatment zones downstream of the first treatment zone, reducing the carbon content of the melt from the intermediate value to a final value of not less than about 0.001% carbon by the steps of:

i. injecting a gas mixture below the surface of the melt comprising an oxygen enriched gas and an inert gas having a ratio of between about 4:1 oxygen enriched gas to inert gas to about 1:10 oxygen enriched gas to inert gas; and ii. selecting said ratio of an oxygen enriched gas and an inert gas to decrease the tendency for oxidation of said strong oxide forming element within the melt while simultaneously decarburizing and stirring the melt.

10. The process of claim 9 wherein said step of transferring a shallow melt includes transferring a melt having a depth of about 4 to 12 in.

11. The process of claim 9 wherein said step of blowing an oxygen enriched gas includes blowing said enriched gas onto said melt surface at a velocity of about 15 to 30% of supersonic velocity.

12. The process of claim 11 wherein said step of decreasing said carbon content of the melt includes decreasing said carbon content from its initial value to an intermediate value in the range of about 0.2 to about 0.1 wt. % carbon.

13. The process of claim 12 wherein said oxygen enriched gas is primarily oxygen.

14. The process of claim 13 wherein said inert gas is selected from the group comprising nitrogen and argon.

15. The process of claim 9 wherein said metal alloy is an iron base alloy.

16. The process of claim 9 wherein said metal alloy is a nickel base alloy.

17. The process of claim 9 wherein said treatment zones are adjacent to and connected to each other.

18. The process of claim 1 wherein said strong oxide forming element is chromium.

19. The process of claim 9 wherein said strong oxide forming element is chromium.

* * * * *